United States Patent [19]

Andersson et al.

[11] 4,376,024

[45] Mar. 8, 1983

[54] METHOD FOR THE MANUFACTURE OF CONTAINERS

[75] Inventors: Torsten Andersson, Bara; Bengt Jeppsson, Skanör, both of Sweden

[73] Assignee: PLM Aktiebolag, Malmo, Sweden

[21] Appl. No.: 219,501

[22] Filed: Dec. 23, 1980

[30] Foreign Application Priority Data

Dec. 28, 1979 [SE] Sweden ..... 7910703

[51] Int. Cl.[3] ..... B05D 1/36; C25D 13/06; C25D 13/14; C25D 13/20

[52] U.S. Cl. ..... 204/181 R; 204/181 C; 427/239; 427/271; 427/388.4

[58] Field of Search ..... 204/181 R, 181 T, 181 C; 72/41, 42; 29/527.4; 427/239, 271

[56] References Cited

U.S. PATENT DOCUMENTS 3,849,167 11/1974 Polc et al. ..... 29/527.4
4,108,099 8/1978 Fidler ..... 427/358
4,246,088 1/1981 Murphy et al. ..... 204/181 R

*Primary Examiner*—Howard S. Williams
*Attorney, Agent, or Firm*—Hane, Roberts, Spiecens & Cohen

[57] ABSTRACT

Ironing, drawing and/or other non chip-producing process is used to form a metal workpiece into an article which is then coated with a protective layer. The lubricating agents used in the non-chip-producing process are removed from the surfaces of the formed article in conjunction with the coating of the article with the protective layer. This is done by dissolving the lubricating agents in the liquid which is used in the application of the protective layer and which contains one or more bonding agents which form the protective layer after the treatment is complete. In one preferred embodiment, at least that protective layer which is closest to the material of the container is applied by electrolytic deposition.

9 Claims, No Drawings

METHOD FOR THE MANUFACTURE OF CONTAINERS

FIELD OF THE INVENTION

The present invention relates to the manufacture of metal articles starting with workpieces which by drawing, ironing and/or other non chip-producing process and with the use of lubricating agents are formed into the articles which are thereafter coated with a number of protective layers. In accordance with the invention use is made in the non chip-producing process of lubricating agents which are soluble in liquid containing bonding agents which are deposited from the liquid onto the article so as to form its protective layer.

The present invention is described below in relation to the manufacture of drawn and ironed containers made of metal. The description thereby gives concrete expression to the invention in relation to a specific product area, although the description should not therefore be regarded as restricting the general nature of the invention.

BACKGROUND

The usual starting point in the manufacture of drawn containers made of metal is a circular blank which is drawn into the shape of a cup in which the walls of the cup retain the wall thickness of the circular blank, whereupon the formed cup is ironed to form a drawn and ironed container body, said wall thickness being reduced during the ironing operation and the diameter of the cup preferably remaining essentially unchanged. The material must be lubricated in some way in order to permit the drawing and ironing operations to take place. Use is made in this respect either of a lubricant which is carefully washed off after the drawing and ironing operations, the surfaces then being dried in order to permit the subsequent application of an all-enveloping coating to the drawn and ironed material, or else the circular blank is coated with a metallic or plastic material which has the effect of reducing friction during the drawing and ironing operations and which will in certain cases also bring about an improvement in the workability of the base material. In summing up, the standard procedure for the manufacture of a container with the use of lubricants is made up of the following stages:

(1) Drawing of the circular blank into the shape of a cup;

(2) Ironing of the cup to form the container body;

(3) Trimming of the mouth of the container;

(4) Careful washing of the surfaces of the container body;

(5) Careful drying of the surfaces of the container body;

(6) Internal and external coating in order to produce a base layer;

(7) Drying and curing of the base layer;

(8) Decoration;

(9) Drying and curing of the decoration;

(10) Internal spray painting of the container body;

(11) Drying and curing of the internal spray painting;

(12) Final forming of the mouth of the container body (reduction of the diameter of the mouth and outward displacement of the edge of the mouth);

(13) Inspection;

(14) Packing.

Steps 1–3 and 12 relate to measures which are necessary in order to produce a drawn container from a circular blank, whereas steps 13–14 relate to additional operations which are in themselves necessary in conjunction with the manufacture of the container. Steps 4–11 relate to measures which are intended to make the drawn containers suitable for the storage of the contents and also to enable the desired information and decoration to be applied to the containers. Thus the use of lubricants calls for careful washing in the present state of technology, and the volume of water which is used is surprisingly large. Water consumption of approximately 500 $m^3$ per day is stipulated for a relatively small production plant. Contaminants in the washing water consist mainly of oil and sulphate together with particles of the metal used in the manufacture of the container. The washing water may not be passed directly into the public sewage disposal system and the washing water must be cleaned before being discharged.

As stated previously, in certain circumstances the present state of technology requires the metal surfaces of the circular blank to be given a coating in the form of a metal or plastic material before drawing takes place. After drawing, this coating will form a part or the whole of the base for the one or more protective layers which cover the material surfaces of the formed product. In certain typical applications the purpose of the coating of the circular blank is to increase the workability of the circular blank when it is drawn, whilst in others the coating has a lubricating function. The coating may be applied by various methods, e.g. by electrolytic coating in which material in liquid form is applied to previously cleaned surfaces followed by drying in order to produce a dry film. Examples of the latter alternative are given, for instance, in U.S. Pat. Nos. 3,114,725 and 3,206,848.

Swedish Patent Specification SE No. 326 935 describes a method for increasing the workability of a material with comparatively low formability by electrolytically coating this material with a thin layer of a material with higher formability. Drawing then takes place using lubricants and without any previous heating so as to avoid alloying at the junction between the coating and the base material. Thus according to the Swedish Patent Specification, coating takes place before the material is drawn. According to the present invention, on the other hand, the surfaces of the material are given their protective coatings after the drawing operations are complete.

Swedish Patent Specification SE No. 363 130 also illustrates a method for the pretreatment of material, for example strip or sheet, with a protective layer consisting of a water-soluble, film-forming, organic polymer, said protective layer being capable of acting as a lubricant prior to, for example, rolling, drawing or ironing. Thus Swedish Patent Specification SE No. 363,130 also describes a method in which coating takes place before the material is re-formed. The method is especially intended to produce a surface which is suitable for subsequent enamelling.

British Patent Specification GB No. 1 517 732 describes the use of drawing and ironing in the production of thin-walled containers made of steel. In this process at least one side of a metal sheet is coated with an organic resin, after which the sheet complete with resin is heated so that the resin will adhere to the metal and so that the resin will cure. The circular blanks from which the container is subsequently drawn are then stamped out. The resin acts as a lubricant both in the drawing and the ironing operations. The resin will also contain a lubricating additive where necessary. This British Patent Specification too describes a method in which the material is coated before drawing with a layer which remains on the wall of the container after drawing.

U.S. Pat. No. 4,108,099 describes a process for the manufacture of drawn containers in which the lubricant forms part of the protective layer of the container in addition to acting as a lubricant and as a cooling agent after the drawing operation. Thus this Patent also describes how, before the drawing operation takes place, the base material is coated with an additional material which, on the one hand, enables the actual drawing to take place and which, on the other hand, forms part of the protective layer given to the container after the drawing operation is complete. Specific reference is made to the fact that the appropriate choice of lubricant will produce a surface finish after drawing which is suitable for printing or painting directly without being washed beforehand. Once the drawing operation is complete, however, the container is always dried in an oven. The additional coating on the base material may of course be applied by various methods, for example by rolling together or by shrinking-on, etc.

The use of lubricating agents and cooling agents in conjunction with drawing operations in which the lubricant is washed away after the drawing operation is complete is a method which is in normal use. The lubricants serve no other purpose than to lubricate and to cool. Examples of Patent Specifications relating to arrangements in which lubricants are used in the manner just mentioned are GB No. 1 433 963 and U.S. Pat. No. 4,051,805.

One other problem encountered in conjunction with the manufacture of drawn and ironed containers is to achieve the effective coating of all areas of the internal surface of the container. A simple dipping procedure is not usually sufficient, and methods are often used whereby the coating material is sprayed over the inner surfaces of the container through nozzles which are surrounded by the body of the container during the spraying operation. Cost considerations mean that the thinnest possible material is used for the container, which gives rise to problems in combining together with requirements for a sufficiently large base and the requirements for the ability to resist deformation where the contents are stored under pressure, for instance in the case of carbonated drinks. U.S. Pat. No. 3,693,828 is an example of an invention in which the shape of the base has been brought into line with the aforesaid requirements at the same time as the shape of the base also meets the need to be able, with the aid of a number of nozzles, to distribute an all-enveloping coating layer over the internal surfaces of the container body.

We are familiar in other contexts with the production of protective layers by the electrolytic coating of conducting surfaces. We are also familiar with equipment for coating both the internal and external surfaces of container bodies. A method and a device for this purpose appear in U.S. Pat. No. 4,094,760, for example. This Patent assumes that the surfaces have already been treated in such a way that they are ready to receive a coating produced by an electrolytic process.

The use of the electrolytic coating of the surfaces of articles made from sheet metal material is also discussed, for example, in British Patent Specification GB No. 1 117 831 which contains a description of how damage to the paint layer on, for instance, tin cans may be repaired by means of electrolytic coating. It is stated in the British Patent Specification that the electrolyte consists of an aqueous emulsion and that after completion of the coating operation the surfaces are washed using de-ionized water. It is also stated that the electrolytic coating procedure may include not only the repair of any damage which has occured but may also be used in place of other forms of protective coating. The aim of this British Patent Specification is to describe a method and a device for producing the electrolytic coating, and it does not concern itself with how the surface of the articles is to be prepared so as to be receptive to the electrolytic coating. The British Patent Specification therefore assumes that the surfaces have been cleaned in some way or have been treated in some other way so that they may be covered by a protective layer which is deposited electrolytically.

SUMMARY OF THE INVENTION

The present invention is directed to a process for the manufacture of drawn and ironed containers in which the number of manufacturing operations has been reduced considerably. The careful washing required by the previously applied methods is replaced by a simple rinsing operation using de-ionized water, but at the same time the use of a lubricant is retained in order to facilitate the drawing operation and to achieve good quality and acceptable scrap levels from the production process.

According to the present invention, the manufacture of a drawn and ironed container takes place in the following stages:

(1) Drawing of the circular blank into the shape of a cup;

(2) Ironing of the cup to form the container body;

(3) Trimming of the mouth of the container;

(4) Simultaneous internal and external electrolytic coating with a protective layer;

(5) Rinsing with de-ionized water;

(6) Partial drying;

(7) Decoration;

(8) Drying and curing of the decoration;

(9) Final forming of the mouth of the container body (reduction of the diameter of the mouth and outward displacement of the edge of the mouth);

(10) Inspection;

(11) Packing.

It may be seen from the above that in relation to the previously described method in normal use, stages 4–7 and 10–11 have been eliminated from the previously used method and replaced by the new stages 4–6, with the result that the number of manufacturing operations has been reduced from 14 to 11.

After the container has been trimmed in accordance with stage 3 above a layer of paint is applied to the inner and outer surface of the container by the process known as electro-painting, in which the electrolyte is in the form of an aqueous dispersion containing ionized bonding agents. Electro-painting takes place without previous washing, which is made possible because the lubricant used in the drawing operation is soluble in the electrolyte in which the container is situated during the painting operation. Furthermore the substance selected as the lubricant is one which will have no adverse effect on the contents in respect of taste, to color or appearance. Electro-painting is not restricted to the use of special painting equipment, but may be used in conjunction with all the processes and devices which in accordance with the present state of technology will produce satisfactory coating of the surfaces of the container body. The surfaces are rinsed clean after painting using deionized water. It has proved to be a simple matter to remove the residue of the electrolyte remaining on the walls of the container during the rinsing operation.

DESCRIPTION OF PREFERRED EMBODIMENTS

Surprisingly, a lubricant consisting of polyethylene-polypropylene dispersed in a mixture of monoethyl glycol ether and water has been found to exhibit the necessary properties in respect of lubricating ability, solubility in the electrolyte, and lack of adverse effect on the contents.

The lubricant contains the following ingredients in one preferred composition:

| | |
|---|---|
| polyethylene-polypropylene | 20–30 percent by weight, |
| preferably approx. | 25 percent by weight, |
| monoethyl glycol ether | 30–40 percent by weight, |
| preferably approx. | 35 percent by weight, |
| water | 30–50 percent by weight, |
| preferably approx. | 40 percent by weight, |

The electrolyte consists of water in which lubricant is present in solution and in which ionized bonding agents are dispersed so that the electrolyte contains the following constituent bonding agents:

| | |
|---|---|
| acrylic resin approx. | 0–9 percent by weight, |
| preferably approx. | 0–3 percent by weight, |
| polyester resin approx. | 0–9 percent by weight, |
| preferably approx. | 5–9 percent by weight, |
| plasticized melamine resin approx. | 0–4 percent by weight, |
| preferably approx. | 1–3 percent by weight, |
| monomer melamine resin approx. | 0–1 percent by weight, |
| water-soluble solvents such as alcohols or monoethyl glycol ethers approx. | 0.5–3.0 percent by weight, |
| preferably approx. | 2 percent by weight, |
| water-insoluble solvents such as isodecanol, isotridecyl alcohol, dodecanol and tetradecanol approx. | 0.5–2.0 percent by weight, |
| preferably approx. | 1 percent by weight, |
| plus primary, secondary or tertiary amines with a pH of 7.8–8.6 | |
| And, where a white coating is required, with the addition of: | |
| titanium dioxide approx. | 4–5 percent by weight. |

Thus the present invention contemplates a process, which has been simplified when compared to the present state of technology, for the coating of ironed containers with protective layers. In addition to the elimination of the washing operation already referred to above, the present invention provides for the particularly rational application of the protective layers at the same time as the removal of undesired particles from the protective layer by means of a simple rinsing operation in which de-ionized water is used.

According to the present state of technology which has been applied until now, the manufacture of containers from sheet metal material, e.g. tin cans, makes use of either a coating layer which is applied to the material before the container is drawn, or a lubricant which is removed completely from the surfaces of the container by washing before the protective layer is applied. The invention differs from the present state of technology in that the lubricants do not prevent the application of a protective coating an the surfaces of the container in spite of the fact that in accordance with the invention the lubricants are not washed from the surfaces of the container before they are coated with the protective layers and do not form part of the coating. The technical effect in accordance with the present invention is achieved because the lubricants are soluble in the electrolyte in which the bonding agents are present in dispersion and from which the bonding agents are subsequently deposited electrically on the surfaces of the container. Thus, the solubility of the lubricants in the electrolyte means that the surfaces of the container will be freed of residual traces of lubricant in conjunction with coating with the protective layers which is required for the majority of applications.

The present invention has been described above in relation to the use of the electrolytic coating of the surfaces of the drawn articles. The present invention may of course also be applied to other methods of coating. This is conditional upon the lubricating agents being soluble in the liquid which contains one or more bonding agents which form the protective layers after the treatment is complete. Similarly, the present invention may of course also be applied to the manufacture of articles other than containers and in the manufacture of which non chip-forming processes are used.

What is claimed is:

1. A method for producing a metal article with a protective coating layer in which a workpiece is formed into the article by a non chip-producing operation with the use of lubricating agents, said method comprising placing the thus formed article after the forming operation in a liquid containing a bonding agent, dissolving said lubricating agents from the article into said liquid, and coating said bonding agents onto said article to form a protective coating layer thereon.

2. A method as claimed in claim 1 wherein the forming of the article includes drawing the workpiece followed by ironing to produce a container.

3. A method as claimed in claim 1 wherein the protective layer is coated on the article by electrolytically depositing the bonding agents from said liquid onto the article, said liquid constituting an electrolyte.

4. A method as claimed in claim 1 wherein the lubricating agent is in the form of polyethylene-polypropylene dispersed in a mixture of monoethyl glycol ether and water.

5. A method as claimed in claim 4 wherein the composition of the lubricating agent is as follows, in percent by weight:

| | |
|---|---|
| polyethylene-polypropylene | 20 to 30 |
| monoethyl glycol ether | 30 to 40 |
| water | 30 to 50 |

6. A method as claimed in claim 4 or 5 wherein the liquid composition forms an electrolyte consisting essentially of water in which said lubricating agent is present in solution and in which ionized bonding agent is dispersed, and the bonding agent consisting essentially of, in percentby weight.

| | |
|---|---|
| acrylic resin | 0.1 to 9 |
| polyester resin | 0.1 to 9 |
| plasticized melamine resin | 0.1 to 4 |
| monomer melamine resin | 0.1 to 1 |
| water soluble solvents | 0.5 to 3 |

-continued

| | |
|---|---|
| water-insoluble solvents and primary, secondary or tertiary amines with a pH of 7.8–8.6 | 0.5 to 2 |

7. A method as claimed in claim 6 wherein for a white color for said protective layer, said electrolyte further contains titanium dioxide in an amount of between 4 and 5 percent by weight.

8. A method as claimed in claim 1 whereinsaid lubricating agents are water soluble and said liquid comprises water.

9. A method as claimed in claim 8 wherein said article is placed in the said liquid by immersing the article therein so that its corner and outer surfaces are brought into contact with the liquid to dissolve said lubricating agents and provide for the coating of the entire surface thereof with said protective coating layer.

* * * * *